US007134375B2

(12) United States Patent
Fish, Jr.

(10) Patent No.: US 7,134,375 B2
(45) Date of Patent: Nov. 14, 2006

(54) VISUAL ASSISTANCE GUIDE SYSTEM FOR DISRUPTER PLACEMENT AND METHOD OF USE

(76) Inventor: James A. Fish, Jr., 4 Island View Dr., Newport News, VA (US) 23602

( * ) Notice: Subject to any disclaimer, the term of this patent is extended or adjusted under 35 U.S.C. 154(b) by 33 days.

(21) Appl. No.: 10/861,477

(22) Filed: Jun. 7, 2004

(65) Prior Publication Data

US 2005/0066799 A1 Mar. 31, 2005

Related U.S. Application Data

(60) Provisional application No. 60/476,235, filed on Jun. 6, 2003.

(51) Int. Cl.
*F42B 3/26* (2006.01)

(52) U.S. Cl. ..... 86/50; 102/275.12

(58) Field of Classification Search ..... 86/50; 273/281, 282.1, 282.2; 102/275.12
See application file for complete search history.

(56) References Cited

U.S. PATENT DOCUMENTS

| | | | | |
|---|---|---|---|---|
| 2,053,454 A | | 9/1936 | Whiteside | 248/524 |
| 2,247,169 A | | 6/1941 | Gilbertson | 102/321 |
| 2,351,297 A | * | 6/1944 | Schwab | 109/26 |
| 3,466,217 A | * | 9/1969 | Mott | 428/42.2 |
| 3,880,429 A | * | 4/1975 | Blumenaus | 273/282.2 |
| 4,169,403 A | | 10/1979 | Hanson | 86/50 |
| 4,767,119 A | * | 8/1988 | Fadner et al. | 273/148 A |
| 5,016,853 A | | 5/1991 | Cox | 248/174 |
| 5,210,368 A | | 5/1993 | Heller, Jr. et al. | 42/84 |
| 6,269,725 B1 | | 8/2001 | Cherry | 86/50 |
| 6,478,300 B1 | * | 11/2002 | Pickett | 273/260 |
| 6,499,706 B1 | | 12/2002 | Sherlock et al. | 248/177.1 |

FOREIGN PATENT DOCUMENTS

DE 38 26 731 A1 * 2/1990 ..... 86/50

OTHER PUBLICATIONS

Phil C. Bennett et al.; Sand Report, 2002-1779, Unlimited Release, Printed Jun. 2002—*Robotic Mobile Manipulation Experiments at the U.S. Army Maneuver Support Center*, Fort Leonard Wood, Missouri, Oct. 30-Nov. 8, 2001; 24 pages.

NIJ Final Report on Law Enforcement Robot Technology Assessment: *Appendix A; Bomb Disposal/Law Enforcement Robot Design Guidelines;* May 28, 2003; 7 pages.

* cited by examiner

*Primary Examiner*—Stephen M. Johnson
(74) *Attorney, Agent, or Firm*—Clark & Brody

(57) ABSTRACT

A visual assistance guide system for placement of a disrupter device for explosive ordinance disposal includes a checkerboard base and adhesive containing areas on the base. One of the adhesive containing areas is used to secure a disrupter device on the base. The checkerboard pattern helps position of the disrupter device (preferably done with a robot) at the proper standoff distance from the package targeted for disposal. Other adhesive areas are located so that a detonation line or shock tube emanating from the disrupter device can be secured to the base in the proper position.

7 Claims, 2 Drawing Sheets

VISUAL ASSISTANCE GUIDE SYSTEM FOR DISRUPTER PLACEMENT AND METHOD OF USE

This application claims priority under 35 USC 119(e) based on provisional patent application No. 60/476,235 filed on Jun. 6, 2003, which is incorporated herein by reference in its entirety.

FIELD OF THE INVENTION

The present invention is directed to a system and method for positioning or locating a disrupter device for explosive ordinance disposal.

BACKGROUND ART

In the prior art, disrupters are used in various forms to neutralize a potentially explosive package so that the package does not detonate in its intended and harmful way. High speed water jets or cannons or other projectiles have been used to break apart the package. Other devices have water-filled components that minimize harmful impact when the package is neutralized.

Another kind is a mineral water bottle (MWB) that contains water and an explosive charge. In use, the bottle is positioned adjacent a target package. One end of a detonation line or shock tube is inside the bottle and interfaces with the charge. The shock tube then runs from the bottle to a remote location where shock tube is used to detonate the explosive charge in the bottle to neutralize or dispose of the targeted package. In certain instances, a robot or unmanned device positions the bottle in a desired location, and controls placement of the shock tube as well. In other instances, a human can position the bottle and the shock tube. The robot can also control the remote detonation under direction from the robot operator, or a human can directly control detonation.

While the use of these types of mineral water bottle disrupters is effective in neutralizing a target package, the placement and operation of the bottles is not without problems. In many instances, the terrain is not flat, and it is difficult to position the bottle in an upright manner. Also, when using robots, lasers are often used to identify where to place the bottle, and environmental conditions can sometime affect the accuracy of the placement. Also, accurate placement using a robot requires intense training and this increases overall costs for these types of operations. Further, because a detonation line or shock tube must run from the disrupter device to a remote location, the line presents the opportunity for its accidental tugging of pulling, whereby the bottle can be upset from its location, and the placement procedure then must be repeated.

Accordingly, a need exists for improved techniques for placing disrupter devices when neutralizing packages. The present invention solves this need by providing a visual assistance guide system, which allows a robot or human to easily, quickly, and accurately locate a disrupter in a desired location regardless of the type of terrain or other environmental conditions.

SUMMARY OF THE INVENTION

It is a first object of the invention to provide a guide system for placement of a disrupter device in the vicinity of a target package, e.g., an improvised explosive device (IED) that requires surveillance and disposal.

Another object of the invention is a method of placing a disrupter device using the inventive guide system.

Other objects and advantages will become apparent as a description thereof proceeds.

In satisfaction of the foregoing objects and advantages, and in one aspect, the invention comprises a guide system for placing a disrupter device such as a water- and explosive-containing bottle near a given target. The system includes a base having a checkerboard pattern and a first substrate of defined size mounted to the base, the first substrate having at least one adhesive surface. A number of second substrates are provided, each second substrate being mounted along a periphery of the base, and having at least one adhesive surface. The adhesive surface of the first substrate is adapted to hold a disrupter device in a location spaced from an edge of the base and defined by squares of the checkerboard pattern. The adhesive surface of one of the second substrates is adapted to hold a portion of a detonation line extending from the disrupter device.

The checkerboard pattern can have any pattern, but is preferably black and white, and the squares could have any dimension although one inch sides are preferred. The base can be made of any material but is preferably made of cardboard, corrugated plastic and the like. While the first and second substrates can be mounted to the base in any manner, a preferred mode is through use of an adhesive. The first and second substrates can also include a removable top layer, removal thereof exposing the adhesive surfaces.

The system is especially adapted for use with one or more water- and explosive charge-containing disrupter devices, the device(s) placed or located on the first substrate.

The invention is also an improvement in the method of placing at least one disrupter device at a predetermined location near a target package, and detonating the disrupter device using a detonation line extending from the disrupter device to a remote detonation site. According to the invention, the method includes providing the base having a checkerboard pattern, the base having at least one central adhesive surface and a number of peripheral adhesive surfaces.

The base is positioned near the target package and the disrupter device is placed on the central adhesive surface using squares on the checkerboard pattern to determine a standoff distance from the target package. A portion of the detonation line of the disrupter device is placed on at least one of the peripheral adhesive surfaces.

The method can utilize a base incorporating the other features of the invention as described above. In an alternative method, the disrupter device and detonation line are placed first, and the base is then positioned near the target package. A robot can be used for the positioning and placing steps and the at least one disrupter device can be one or more of the water- and explosive charge-containing disrupter devices.

BRIEF DESCRIPTION OF THE DRAWINGS

Reference is now made to the drawings of the invention wherein.

DESCRIPTION OF THE PREFERRED EMBODIMENTS

The present invention offers a superior way to place a disrupter device regardless of the terrain involved and within the tolerances required for these types of placement. The inventive guide system is designed to assist IED Render Safe Procedures (RSP's) by providing for more rapid, stable deployment of light disrupter devices, particularly the mineral water bottle type disrupter devices or MWB's. The inventive system and method of use are particularly helpful for robot operations, assisting the operator with both visual depth perception and stable deployment. The system and method also facilitate manual deployment and potentially reduce the explosive ordinance disposal (EOD) tech's "time on target".

Figure 1:
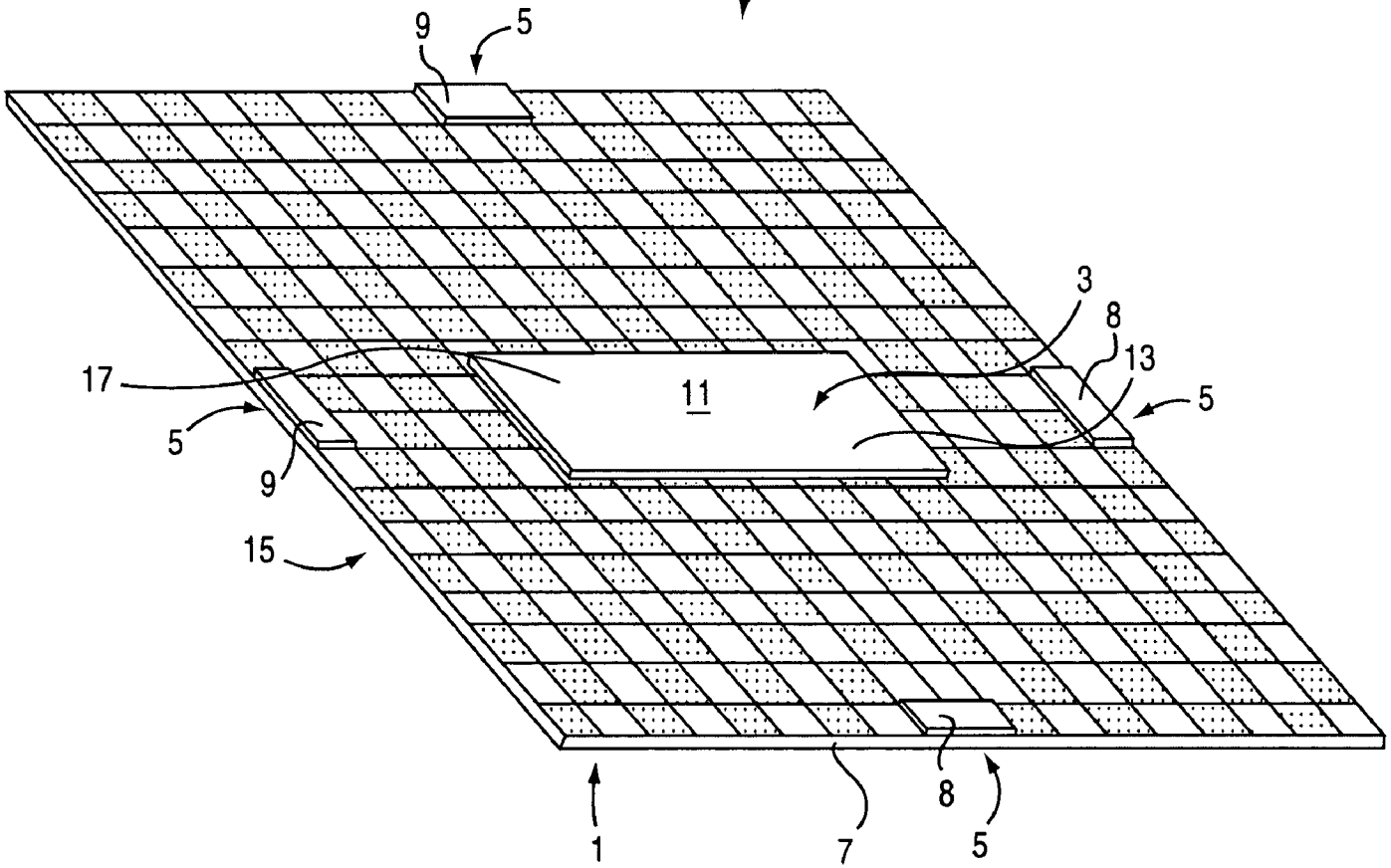
FIG. 1 is a perspective view of the inventive system.

Referring now to FIG. 1, the system is designated by the reference numeral 10 and is seen to include a base 1 having a checkerboard pattern of alternating squares of white and black color. While other contrasting color schemes or patterns could be used, it is preferred to use black and white since the contrast afforded by such adjacent squares makes it easy to visually position the disrupter device in the proper location.

The base could be made of any material, but a preferred material is one that would not frag or produce harmful debris when the charge in the disrupter is detonated. One such material is cardboard, corrugated plastic or the like. Cardboard is also advantageous in that it is readily cut so that the base could be altered to fit a particular location.

The base also has a number of substrates mounted to it. One substrate 3 is centrally located on the base, with a number of other substrates 5 positioned along the peripheral edge 7 of the base 1. The substrates 3 and 5 can be mounted to the base in any known fashion, such as by application of contact adhesive to the base and/or underside of the substrate, or by using substrate materials that have their own adhesive layer.

In a preferred mode, the substrates 5 can be double sided tape, with one side being used to attach the tape to the base, and the other side used in securing disrupter components. This type of tape is equipped with two removable layers. One layer is removed so that the tape can be positioned along the peripheral edge 7 of the base 1. The other removable layer is kept in place until ready to use as described below. FIG. 1 shows the layers 8 in place on two substrates with two other substrates showing the adhesive surface 9 of the tape being exposed.

It should be understood that the substrates 5 can be located along the edge 7 or spaced inward therefrom a distance, if so desired. The purpose of the substrates 5 is to provide a securement point for the detonation line or shock tubing that emanates from the disrupter device and runs to a remote location for disrupter detonation. Therefore, the exact dimensions and location are not absolutely critical, just that the substrates 5 should be large enough to provide sufficient sticking area, and are spaced apart enough so that the operator has an option of which substrate to use. The substrates should also close enough to the edge to allow for attachment to the detonation tubing without interference from the disrupter device itself.

The central substrate 3 is larger in profile than the outer substrates 5 since it must provide a securement point for the disrupter itself. The substrate 3 can be any type of substrate that would allow its attachment or mounting to the base, and provide an adhesive surface 11 to hold the disrupter device in place. While the two sided tape could work for the central substrate, its larger dimensions do not readily match dimensions of tape that are readily available. One material that is ideal is a mouse trap board, which can be purchased in most hardware or home stores. This board has an adhesive on one surface that is normally covered with a protective film. Since the board has only one adhesive side for trapping mice, the other side must be adhered to the base using another adhesive, either by applying the adhesive to the board, the base or both. Of course, other means could be used to secure the substrates to the base, low frag mechanical fasteners, sewn joints, etc.

As with the substrates 5, the dimensions of substrate 3 are not critical, just that the substrate 3 should be large enough to accommodate the footprint of the disrupter device, and preferably larger so that there is some room to optimize the placement of the disrupter on the substrate when considering the target package or item that is to be disrupted. A preferred size of the substrate 3 would be 3×8 inches.

While only one central substrate is shown, two or more could be used if multiple disrupter devices are contemplated. Likewise, although the base is shown with a square configuration, other shapes and edge configurations could be employed.

Still referring to FIG. 1, an exemplary use of the system when using a mineral water bottle as the disrupting device is as follows.

First, prepare the disrupter (MWB) in the usual fashion and fill with water; ensuring that the disrupter (MWB) is dry on the bottom so that it does not wet the cardboard base.

Use a slow and steady tug to remove the protective "release" paper from the substrate 3 to expose the adhesive surface 11 that will hold the disrupter (MWB). Carefully place the disrupter (MWB) on the adhesive surface at the recommended standoff distance from the edge of the base 1 that will be closest to the target. The position of placement on the substrate 3 takes into account the recommended standoff distance. For example, the MWB can be placed at one end 13 of the substrate, with the edge 15 being closest to the target to provide a large standoff distance. Alternatively, the MWB can be placed at the end 17 to provide a short standoff distance from edge 15.

The base 1 is designed to easily provide any number of standoff distances, which is the distance between the disrupter and the target package. The standoff distance can vary depending on the disrupter and the target package, and the invention allows the selection of virtually any standoff distance depending on the particulars of the situation requiring disruption. The substrate 3 can be positioned so that the distance from the edge of the adhesive surface 11 to each of the four sides uses convenient standoff distances. Other standoff distances can be attained by using a cutting device such as a utility knife to remove a portion of the base 1. When using one inch squares on the base, rapid visual distance confirmation during setup and deployment is attained. Of course, other dimensions could be used for the checkerboard pattern.

Once the disrupter (MWB) has been positioned on the base 1, it is preferred to replace portion(s) of the release paper to cover any large remaining exposed adhesive surface 11 so that it will not adhere to unintended objects (gripper robot jaws, etc.) during deployment.

Once the MWB is secured, its shock tube can be secured to the desired perimeter edge substrate 5 (usually the side opposite to where the target will be). The release paper from the sticky tape at the desired edge can be removed, and the shock tube can be pressed on to the sticky tape. While this may have sufficient holding power, the shock tube can be covered with electrical or duct tape, so that the shock tube is "sandwiched" between the sticky tape 5 on the base 1 and the electrical (or duct) tape.

By securing the shock tube to the peripheral edge of the base 1, an accidental tug or pull on the shock tube will be transmitted to the base 1, and not the disrupter (MWB).

For robot operations with the MWB, it is preferred to have the gripper of the robot hold the MWB, and then the base will remain adhered to the bottom of the disrupter. In this mode, the robot operator may place the system with the MWB directly in position, or may choose to place the system with the MWB near the IED, and then slowly nudge the entire assembly into final position using one of the robot's members.

Figure 2:
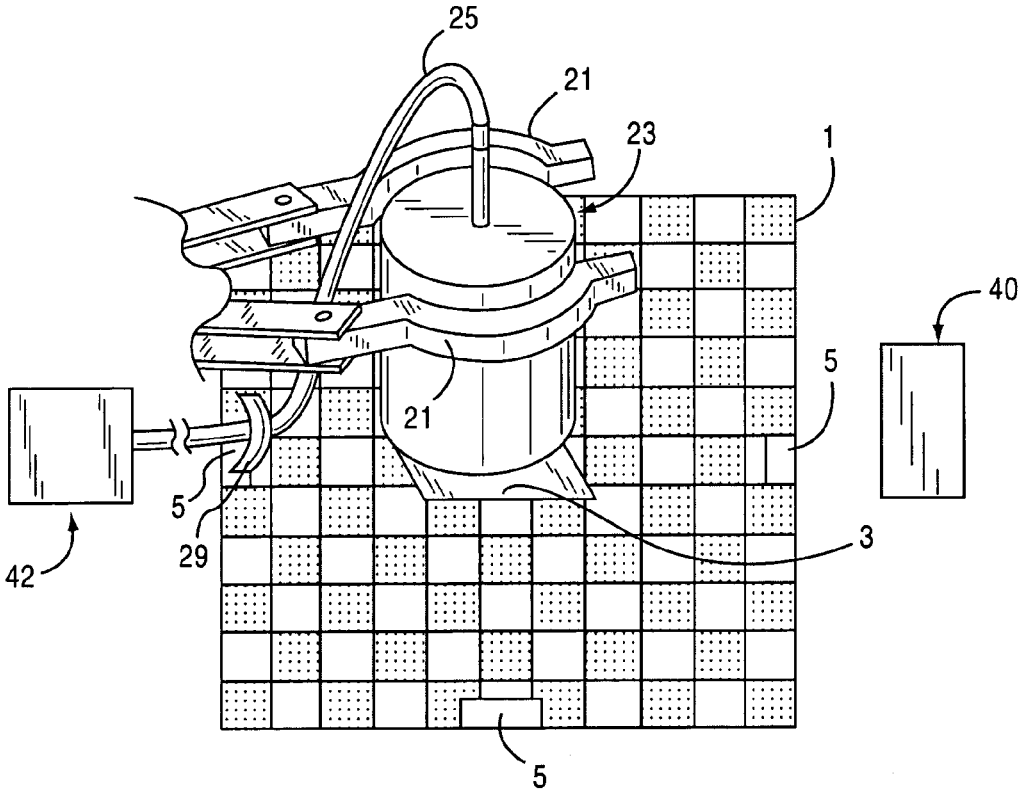
FIG. 2 is a perspective view of the inventive system showing parts of a robot and a mineral water bottle disrupter device.

FIG. 2 shows the arms 21 of a robot (not shown) holding a MWB 23 that is secured to the substrate 3. The peripheral substrates 5 are also shown in FIG. 2, as is the shock tube 25. The robot can hold the entire system off the ground, because the MWB 23 standoff distance is set before the base is positioned near the IED, shown schematically as 40. The robot could then position the base 1 at the desired location, or position it in a preliminary position, and then slide the base 1 into its final position. FIG. 2 also shows the shock tube 25 held in place with electrical tape 29 at the substrate 5, which is opposite the edge 15 intended to be closest to the desired target. The shock tube is also shown leading to a detonation site, shown schematically as 42.

While one disrupter is shown in use with the inventive guide system, more than one disrupter could be used, and the base 1 could accommodate more than one central substrate to secure multiple disrupters. In these instances, the base may be made with a heavier duty construction in order to adequately support additional disrupters.

Further, while an MWB is illustrated as one type of a disrupter for use with the inventive guide system, other types of light weight and easily moved and positioned disrupters could also be employed without departing from the scope of the invention.

The checkerboard pattern also provides a record of the placement of the disrupter device when the placement procedure is being filmed. That is, one can review the tape of the procedure and readily determine by viewing the squares on the base as to whether the disrupter was placed at the proper standoff distance.

As such, an invention has been disclosed in terms of preferred embodiments thereof which fulfills each and every one of the objects of the present invention as set forth above and provides a new and improved visual assistance guide system for disrupter placement and method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A guide system for placing a disrupter device comprising:

a) a base having a checkerboard pattern;

b) a first substrate of defined size mounted to the base, and having at least one adhesive surface; and c) at least one second substrate mounted along a periphery of the base, and having at least one adhesive surface;

d) wherein the at least one adhesive surface of the first substrate is adapted to hold the disrupter device in a location spaced from an edge of the base and defined by squares of the checkerboard pattern, and the at least one adhesive surface of the at least one second substrate is adapted to hold a portion of a detonation line extending from the disrupter; and e) at least one water- and explosive charge-containing disrupter device located on the first substrate as the disrupter device.

2. In a method of placing at least one disrupter device at a predetermined location near a target package, and detonating the disrupter device using a detonation line extending from the disrupter device to a remote detonation site, the improvement comprising:

a) providing a base having a checkerboard pattern, the base having at least one central adhesive surface and one or more peripheral adhesive surfaces;

b) positioning the base near the target package;

c) placing the disrupter device on the central adhesive surface using squares on the checkerboard pattern to determine a standoff distance from the target package; and d) placing a portion of the detonation line on one of the peripheral adhesive surfaces.

3. The method of claim 2, wherein the base with the central adhesive surface and one or more peripheral adhesive surfaces further comprises a) a base having a checkerboard pattern;

b) a first substrate of defined size mounted to the base, and having at least one adhesive surface; and c) at least one second substrate mounted along a periphery of the base, and having at least one adhesive surface;

d) wherein the at least one adhesive surface of the first substrate is adapted to hold a disrupter device in a location spaced from an edge of the base and defined by squares of the checkerboard pattern, and the at least one adhesive surface of the at least one second substrate is adapted to hold a portion of a detonation line extending from the disrupter.

4. The method of claim 2, wherein the disrupter device and detonation line are placed first, and the base is then positioned near the target package.

5. The method of claim 2, wherein two or more disrupter devices are provided and placed on the base.

6. The method of claim 2, wherein a robot is used for the positioning and placing steps.

7. The method of claim 2, wherein the at least one disrupter device is a water- and explosive charge-containing disrupter device.

* * * * *

UNITED STATES PATENT AND TRADEMARK OFFICE

CERTIFICATE OF CORRECTION

PATENT NO. : 7,134,375 B2
APPLICATION NO. : 10/861477
DATED : November 14, 2006
INVENTOR(S) : Fish, Jr.

It is certified that error appears in the above-identified patent and that said Letters Patent is hereby corrected as shown below:

Title page, Item (57) Abstract, line 2: “ordinance” should read --ordnance--

Column 1, line 14: “ordinance” should read --ordnance--

Column 3, line 7: “ordinance” should read --ordnance--

Signed and Sealed this

Third Day of July, 2007

JON W. DUDAS
*Director of the United States Patent and Trademark Office*